US007574998B2

(12) United States Patent
Idogawa et al.

(10) Patent No.: US 7,574,998 B2
(45) Date of Patent: Aug. 18, 2009

(54) IGNITION APPARATUS FOR AN INTERNAL COMBUSTION ENGINE

(75) Inventors: Takashi Idogawa, Tokyo (JP); Takeshi Shimizu, Tokyo (JP); Shigemi Murata, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 111 days.

(21) Appl. No.: 11/808,980

(22) Filed: Jun. 14, 2007

(65) Prior Publication Data

US 2008/0156304 A1 Jul. 3, 2008

(30) Foreign Application Priority Data

Dec. 28, 2006 (JP) ..... 2006-355184

(51) Int. Cl.
*H01F 38/12* (2006.01)
*H01F 38/00* (2006.01)

(52) U.S. Cl. ..... 123/634

(58) Field of Classification Search ..... 123/634, 123/635; 336/225; 174/126.1, 126.4
See application file for complete search history.

(56) References Cited

U.S. PATENT DOCUMENTS 5,268,663 A * 12/1993 Takeuti et al. ..... 336/212
5,977,856 A * 11/1999 Maekawa et al. ..... 336/96

FOREIGN PATENT DOCUMENTS

| | | | |
|---|---|---|---|
| JP | 10-012466 | | 1/1998 |
| JP | 10-022144 | A | 1/1998 |
| JP | 2004-319617 | | 11/2004 |
| JP | 2005-150310 | A | 6/2005 |
| JP | 2005-302959 | | 10/2005 |
| JP | 2006203043 | * | 8/2006 |

OTHER PUBLICATIONS

JP 2006-203043 (Fujiyama T) Aug. 13, 2006 (translation).[online] [retrieved on Dec. 1, 2008]. Retrieved from: IPDL PAJ:<URL:http://www.ipdl.inpit.go.jp/homepg_e.ipdl>.*

* cited by examiner

*Primary Examiner*—Mahmoud Gimie
(74) *Attorney, Agent, or Firm*—Sughrue Mion, PLLC

(57) ABSTRACT

An ignition apparatus for an internal combustion engine can prevent dielectric breakdown resulting from voids, thus making it possible to reduce its size. The apparatus includes a primary bobbin, a primary coil formed of a primary coil conductor wound around the primary bobbin, a secondary bobbin arranged in concentric relation to the primary bobbin, a secondary coil formed of a secondary coil conductor wound around the secondary bobbin, an insulation casing receiving therein the primary bobbin, the primary coil, the secondary bobbin and the secondary coil, and an insulating resin filled into the insulation case. Grooves for guiding the insulating resin between the primary bobbin and the primary coil are formed on an outer peripheral surface of the primary bobbin around which the primary coil conductor having a polygonal cross section is wound.

7 Claims, 10 Drawing Sheets

IGNITION APPARATUS FOR AN INTERNAL COMBUSTION ENGINE

BACKGROUND OF THE INVENTION

1. Field of the Invention

The present invention relates to an ignition apparatus for an internal combustion engine which is mounted the internal combustion engine of a vehicle such as an automobile for applying a high voltage to spark plugs to generate spark discharges.

2. Description of the Related Art

In the past, in an ignition apparatus for an internal combustion engine as described in a first patent document (Japanese patent application laid-open No. H 10-22144), a primary coil conductor (referred to as a round conductor) having a round shape in cross section is wound around a primary bobbin. In the case of using this round conductor, the rate of gaps or spaces generated between adjacent portions of the round conductor is high, so the space factor of the primary coil, which is formed of the primary coil conductor wound around the primary bobbin, is low.

In contrast to this, a second patent document (Japanese patent application laid-open No. 2005-150310) discloses a coil conductor which takes a rectangular cross-sectional shape so as to increase the space factor of a coil for reduction in size.

In the ignition apparatus for an internal combustion engine described in the above-mentioned first patent document, the adjacent portions of the round conductor are in line to line contact with each other, so an insulating resin can be easily impregnated between the primary bobbin and the primary coil though the space factor of the primary coil is low.

In contrast to this, if the coil conductor described in the above-mentioned second patent document is applied to the ignition apparatus for an internal combustion engine, there is the following problem. That is, the adjacent portions of the primary coil conductor is in surface to surface contact with each other, so an insulating resin can not be easily impregnated between the primary bobbin and the primary coil, thus generating voids, as a result of which a high voltage is impressed to the voids, generating dielectric breakdown between the primary bobbin and the primary coil.

SUMMARY OF THE INVENTION

Accordingly, the present invention is intended to obviate the problems as referred to above, and has for its object is to obtain an ignition apparatus for an internal combustion engine which is capable of preventing dielectric breakdown resulting from voids thereby to make it possible to reduce the size thereof.

Bearing the above object in mind, according to the present invention, there is provided an ignition coil apparatus for an internal combustion engine, which includes: a primary bobbin; a primary coil that is formed of a primary coil conductor wound around the primary bobbin; a secondary bobbin that is arranged in concentric relation to the primary bobbin; a secondary coil that is formed of a secondary coil conductor wound around the secondary bobbin; an insulation casing that receives the primary bobbin, the primary coil, the secondary bobbin and the secondary coil; and an insulating resin that is filled into the insulation casing. A groove for guiding the insulating resin between the primary bobbin and the primary coil is formed on an outer peripheral surface of the primary bobbin around which the primary coil conductor having a polygonal cross section is wound.

According to the ignition apparatus for an internal combustion engine of the present invention as stated above, dielectric breakdown resulting from voids can be prevented, thus making it possible to reduce the size of the primary coil.

The above and other objects, features and advantages of the present invention will become more readily apparent to those skilled in the art from the following detailed description of preferred embodiments of the present invention taken in conjunction with the accompanying drawings.

DESCRIPTION OF THE PREFERRED EMBODIMENTS

Figure 1:
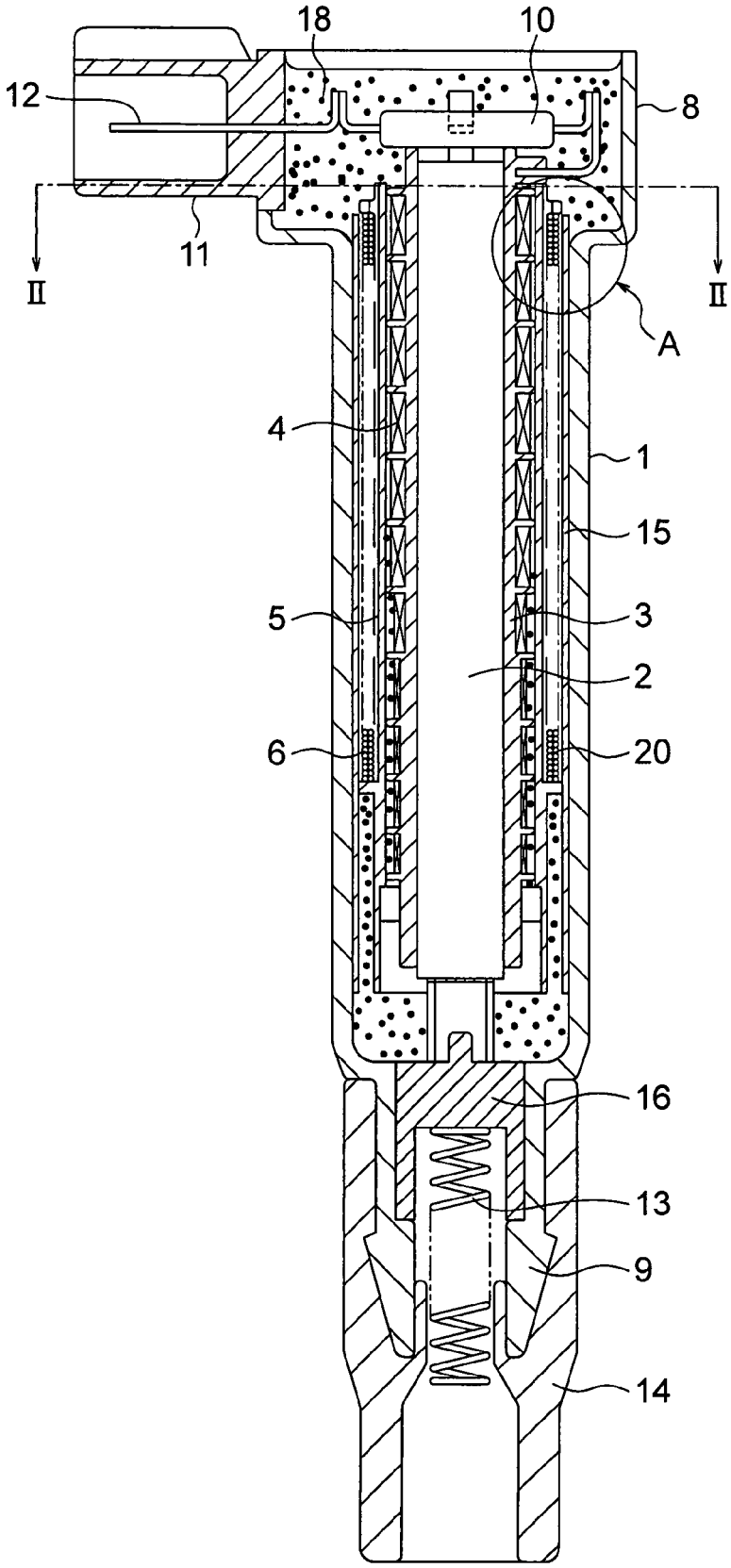
FIG. 1 is a cross sectional front elevational view showing an ignition apparatus for an internal combustion engine according to a first embodiment of the present invention.

Now, preferred embodiments of the present invention will be described in detail while referring to the accompanying drawings. Throughout respective figures, the same or corresponding members or parts are identified by the same reference numerals and characters.

Embodiment 1

Figure 2:
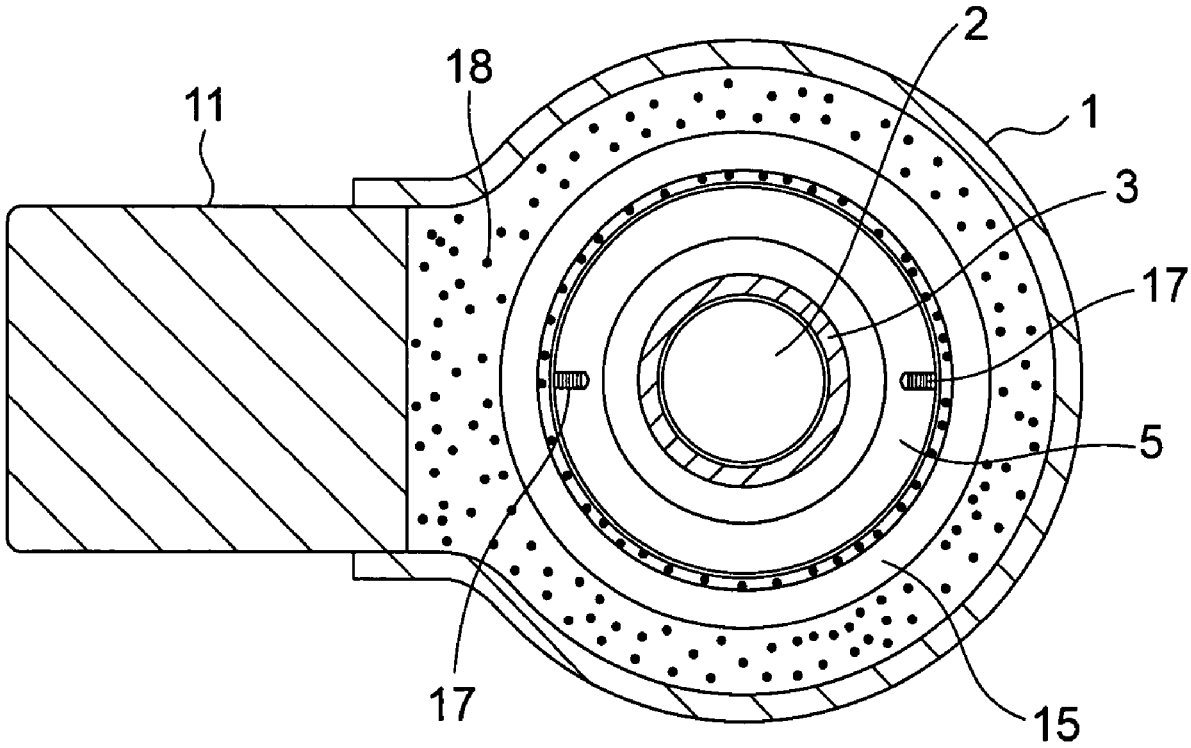
FIG. 2 is a cross sectional arrow view along line II-II of FIG. 1.
Figure 3:
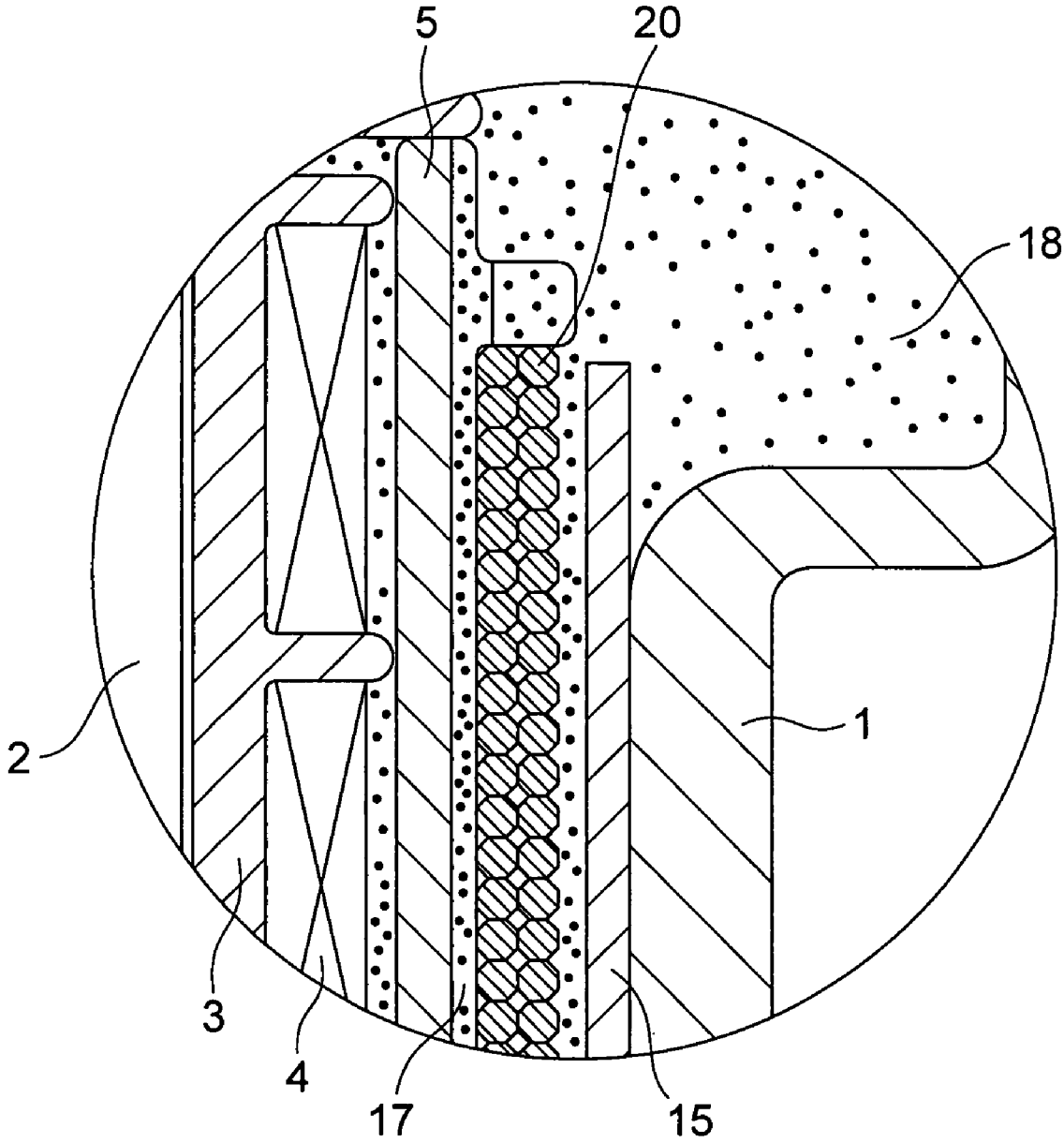
FIG. 3 is an enlarged view of a location A in FIG. 1.

Referring to the drawings and first to FIG. 1, there is shown a cross sectional front elevational view of an ignition apparatus for an internal combustion engine according to a first embodiment of the present invention. FIG. 2 is a cross sectional arrow view along line II-II of FIG. 1, and FIG. 3 is an enlarged view of a location A in FIG. 1.

In the ignition apparatus for an internal combustion engine of this first embodiment, an iron core 2 formed of thin steel plates laminated one over another is arranged on the central axis of an insulation casing 1 of a cylindrical shape. A secondary bobbin 3 of a cylindrical shape is arranged around the iron core 2. A secondary coil conductor is wound around the secondary bobbin 3 to form a secondary coil 4. A primary bobbin 5 of a cylindrical shape is arranged around the outer periphery of the secondary coil 4 in concentric relation therewith. A primary coil conductor 20 is wound around the primary bobbin 5 to form a primary coil 6.

The insulation casing 1 is formed at its one end with an enlarged head 8. This head 8 has an igniter 10 received therein for controlling an excitation current supplied to the primary coil 6, and also has a connector 11 mounted to a side portion thereof. In addition, the insulation casing 1 is formed at its other end with a high voltage tower 9.

The igniter 10 is provided with a control IC (not shown), and a power transistor (not shown) that is driven by a drive signal from the control IC.

On an inner peripheral surface of the insulation casing 1 between the head 8 and a plug boot 14, there is arranged a side iron core 15 which serves as a path for magnetic flux that is generated when a primary current is supplied to the primary coil 6.

In the primary coil 6, the primary coil conductor 20 has an octagonal shape in cross section, as shown in FIG. 3, and the adjacent portions of the primary coil conductor 20 are in surface to surface contact with each other. A pair of grooves 17 are formed along the axial direction of the iron core 2 on the outer peripheral surface of the primary bobbin 5 around which the primary coil conductor 20 is wound, as shown in FIG. 2.

The iron core 2, the secondary bobbin 3, the secondary coil 4, the primary bobbin 5, the primary coil 6 and the igniter 10, which are all received in the insulation casing 1, are insulated and fixedly held by the insulating resin 18 filled in the insulation casing 1.

In this ignition apparatus for an internal combustion engine, an electric signal processed by an engine control unit (not shown) is sent to the control IC of the igniter 10 through a terminal 12 of the connector 11. The control IC generates a drive signal for the power transistor, so that the power transistor controls an excitation current supplied to the primary coil 6 based on the drive signal. As a result, a high voltage is impressed to a high voltage side secondary coil terminal 16, whereby a spark plug (not shown) is caused to discharge at a gap portion between its electrodes through a spring 13.

According to the ignition apparatus for an internal combustion engine as constructed above, the primary coil conductor 20 has an octagonal shape in cross section, so the adjacent portions of the primary coil conductor 20 are in surface to surface contact with each other, and hence the space factor is high.

In addition, the pair of grooves 17 are formed on the outer peripheral surface of the primary bobbin 5 along the axial direction of the iron core 2, so that the insulating resin 18 can be impregnated between the primary bobbin 5 and the primary coil 6 through the grooves 17. As a result, it is possible to prevent the generation of voids between the primary bobbin 5 and the primary coil 6, and hence it is also possible to prevent dielectric breakdown due to the impression of a high voltage to the voids.

Here, note that the grooves 17 are not limited to two locations but may instead be provided at one or three or more locations.

In addition, the direction of the grooves 17 is not limited to the axial direction of the iron core 2, but may be any arbitrary direction.

Embodiment 2

Figure 4:
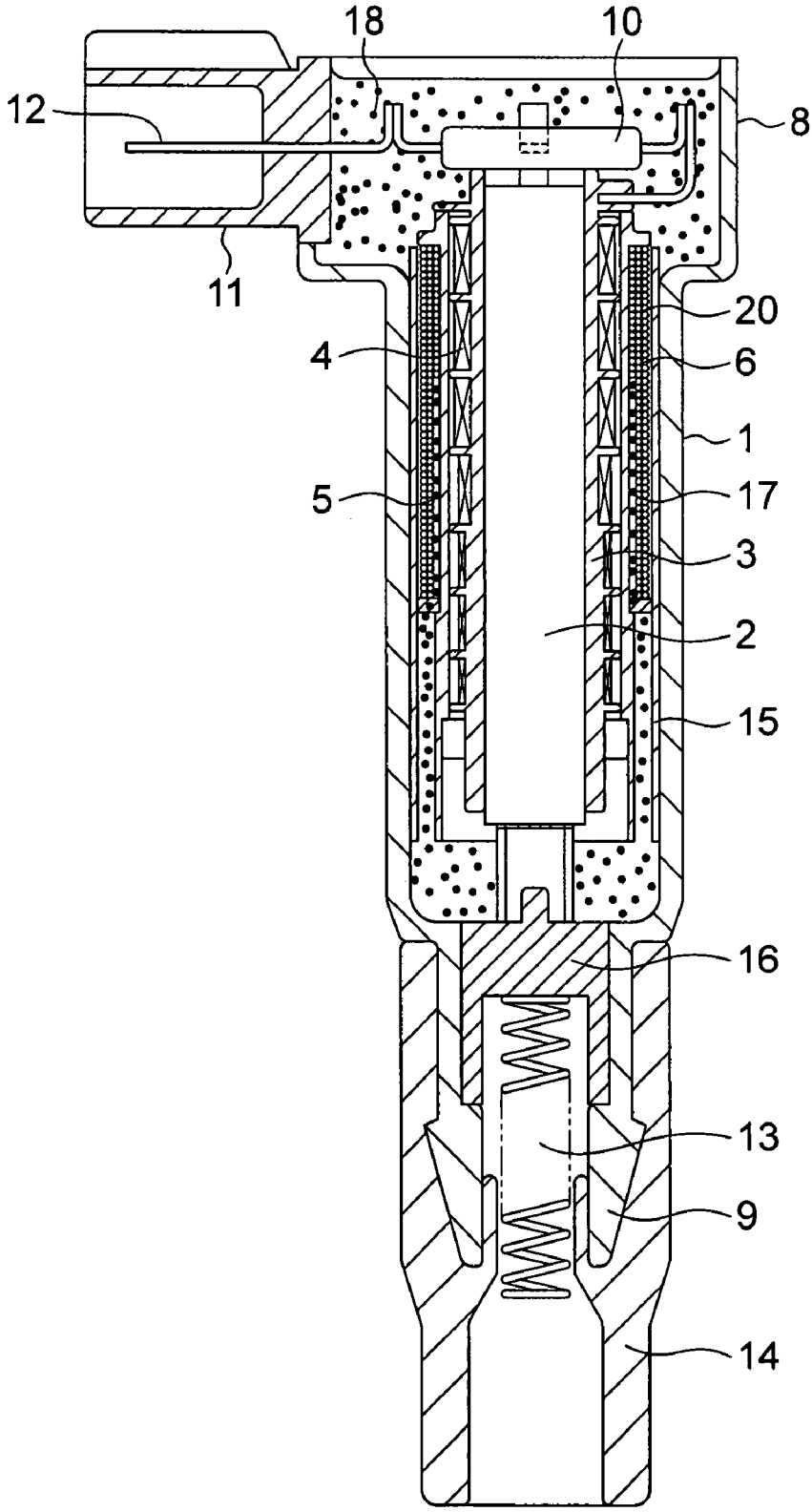
FIG. 4 is a cross sectional front elevational view showing an ignition apparatus for an internal combustion engine according to a second embodiment of the present invention.

FIG. 4 is a cross sectional front elevational view that shows an ignition apparatus for an internal combustion engine according to a second embodiment of the present invention.

In this second embodiment, the grooves 17 are formed only in a high voltage region of the primary bobbin 5 that is arranged in opposition to a high voltage portion of the secondary coil 4. Thus, the diametral dimension of a low voltage region of the primary bobbin 5 arranged in opposition to a low voltage portion of the secondary coil 4 is smaller than that of the high voltage region of the primary bobbin 5 by the depth dimension of the grooves 17, so the number of layers or turns in the low voltage region of the primary coil conductor 20 is more by one than the number of layers or turns in the high voltage region thereof. The other construction of this second embodiment is similar to that of the first embodiment.

In this second embodiment, in the high voltage region of the primary bobbin 5 where dielectric breakdown is apt to occur, the insulating resin 18 is impregnated between the primary bobbin 5 and the primary coil 6 through the grooves 17, whereby the dielectric breakdown resulting from the voids can be prevented.

In addition, in the low voltage region of the primary bobbin 5, the number of turns of the primary coil conductor 20 is more by one than that in the high voltage region, so the winding space of the primary coil conductor 20 can be made larger without lowering the dielectric strength.

Here, note that in the low voltage region of the primary bobbin 5, a large winding space may be secured which is larger, for example by two layers or turns in the number of layers or turns of the primary coil conductor 20, than that in the high voltage region in accordance with the depth of the grooves 17.

Embodiment 3

Figure 5:
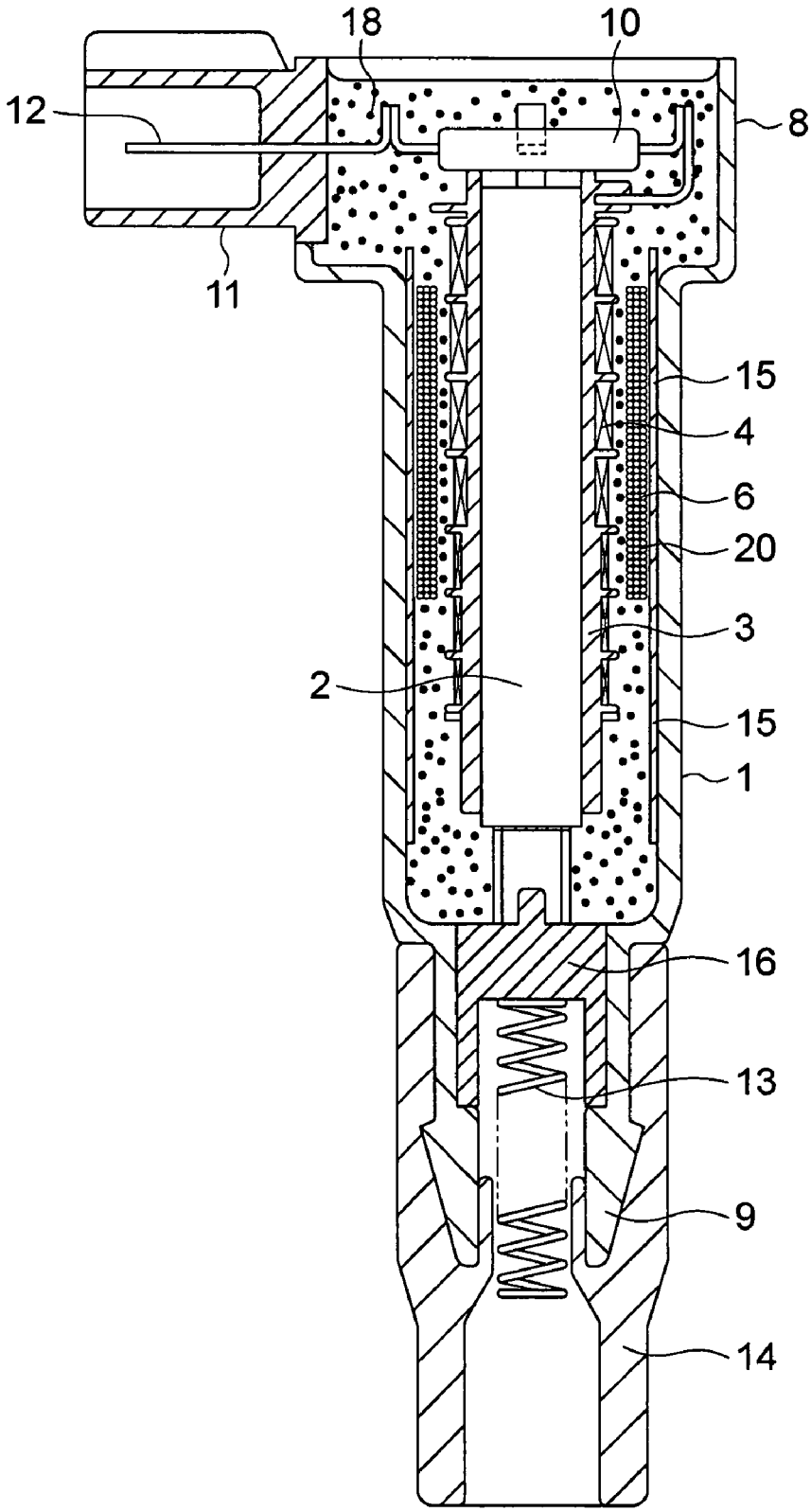
FIG. 5 is a cross sectional front elevational view showing an ignition apparatus for an internal combustion engine according to a third embodiment of the present invention.

FIG. 5 is a cross sectional front elevational view that shows an ignition apparatus for an internal combustion engine according to a third embodiment of the present invention.

In this third embodiment, at an inner side of the primary coil 6 around which the primary coil conductor 20 is wound, there is arranged the secondary bobbin 3 in concentric relation to the primary coil 6.

Figure 6:
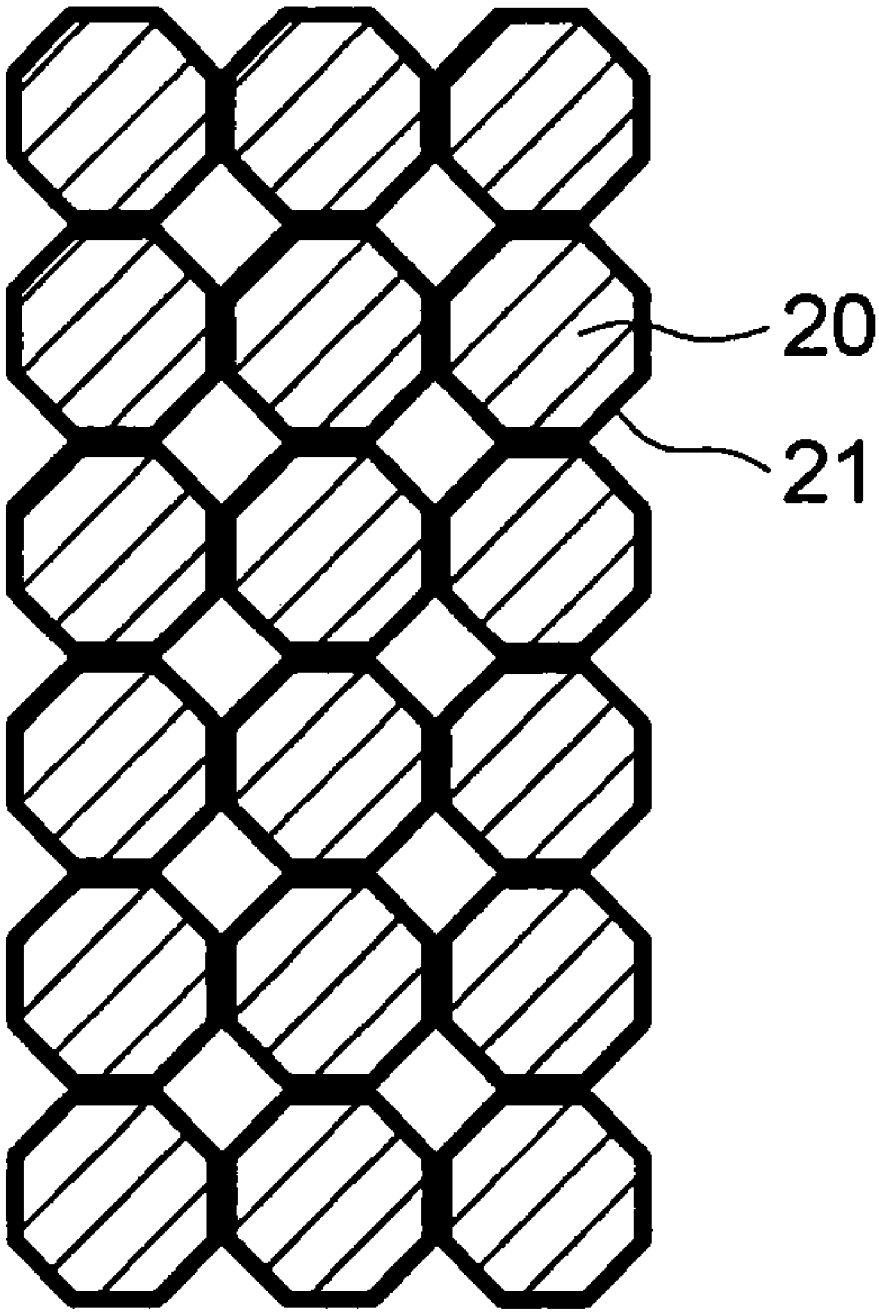
FIG. 6 is an enlarged view of essential portions of FIG. 5.

In the primary coil 6, the primary coil conductor 20 has an octagonal shape in cross section, as shown in FIG. 6, and a self-bonding film 21 comprising a polyvinyl butyral type resin is formed on the surface of the primary coil conductor 20. The other construction of this third embodiment is similar to that of the first embodiment.

In this third embodiment of the present invention, the adjacent portions of the primary coil conductor 20 are bonded to each other through the self-bonding film 21 formed on the surface of the primary coil conductor 20, whereby the collapse of the winding of the primary coil 6 does not occur without using the primary bobbin 5, as a consequence of which the number of component parts can be reduced, and the ignition apparatus for an internal combustion engine can be reduced in size.

In addition, the insulating resin 18 is impregnated into gaps between the secondary coil 4 and the primary coil 6, so dielectric breakdown resulting from voids can be prevented.

Embodiment 4

Figure 7:
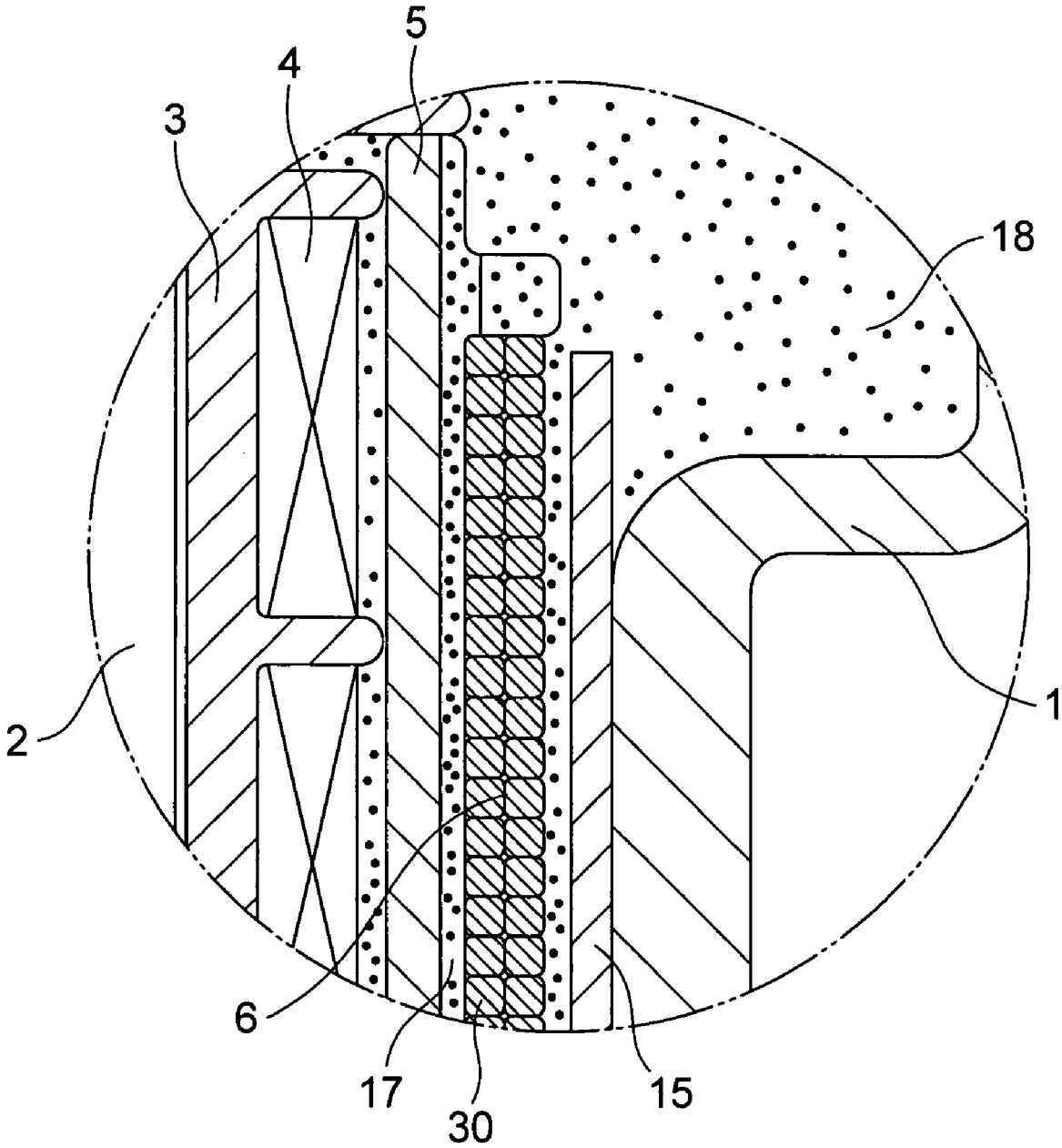
FIG. 7 is a cross sectional view of essential portions showing an ignition apparatus for an internal combustion engine according to a fourth embodiment of the present invention.

FIG. 7 is a cross sectional view of essential portions of an ignition apparatus for an internal combustion engine according to a fourth embodiment of the present invention.

In this fourth embodiment, the primary coil conductor 30 takes a square shape in cross section with four corners being chamfered. The other construction of this fourth embodiment is similar to that of the first embodiment.

According to the ignition apparatus for an internal combustion engine of this fourth embodiment, the primary coil conductor 30 is of a square shape in cross section, so the space factor of the primary coil 6 is larger by a maximum of about 27% in case of the primary coil conductor 30 of a square cross section than in case of the primary coil conductor of a round or circular cross section, and by a maximum of about 20% in case of the primary coil conductor 30 of a square cross section than in case of the primary coil conductor of an octagonal cross section. As a result, the primary coil 6 can be further reduced in size.

However, in case where a chamfering process is not applied to the corners of the primary coil conductor 30 of the square cross section, variation is apt to occur in the thickness of the insulating layer of the primary coil conductor in the corners thereof, a phenomenon is apt to occur in which the insulating layer is dielectrically broken down for instance in a ride-over portion of the primary coil conductor from a first layer (turn) to a second layer (turn) thereof in a winding process of the primary coil conductor.

In contrast to this, in this fourth embodiment, the corners of the primary coil conductor 30 are conferred, so such an inconvenience as stated above does not occur.

Here, note that the cross-sectional shape of the primary coil conductor need only be rectangular, and even with a rectangular cross section, the space factor of the primary coil 6 can be similarly improved.

Embodiment 5

Figure 8:
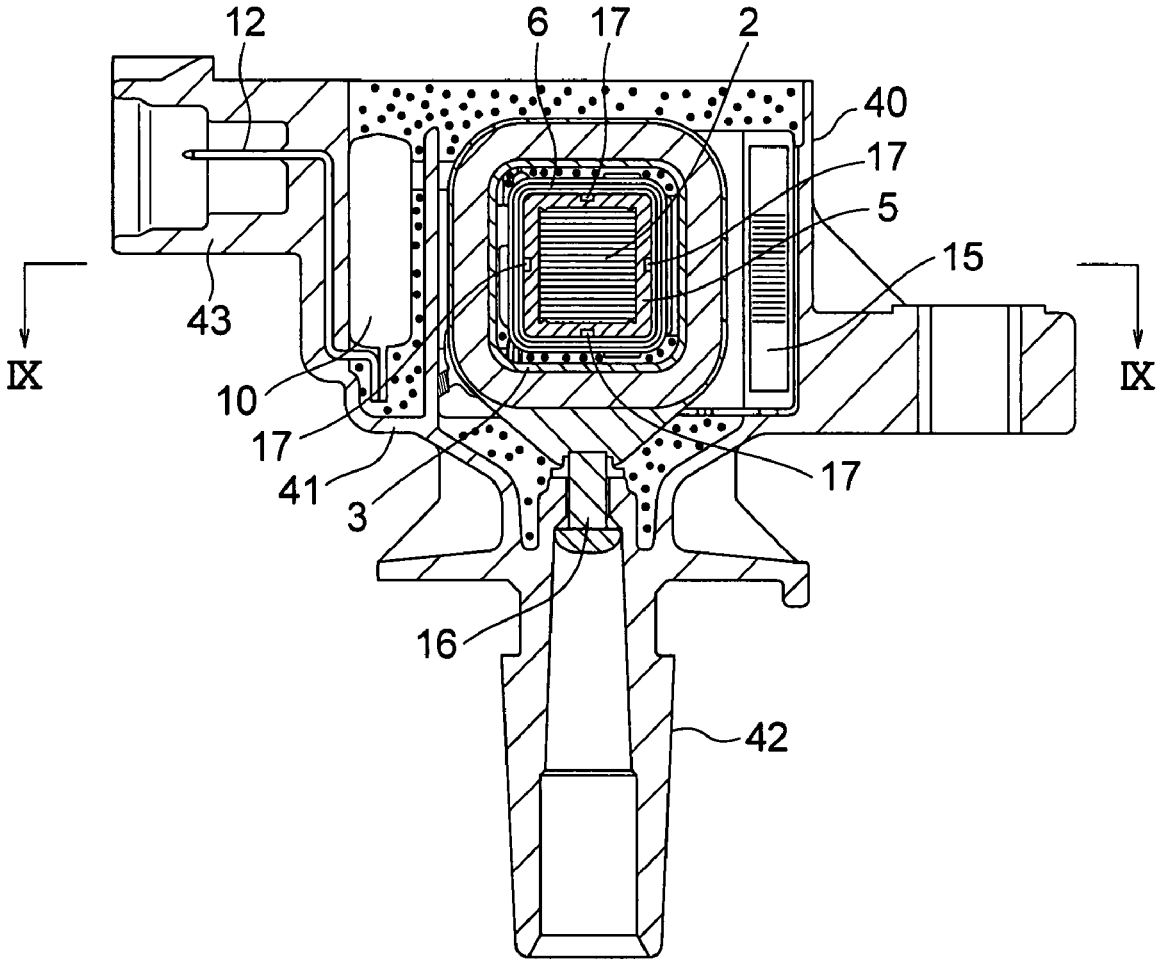
FIG. 8 is a cross sectional front elevational view showing an ignition apparatus for an internal combustion engine according to a fifth embodiment of the present invention.
Figure 9:
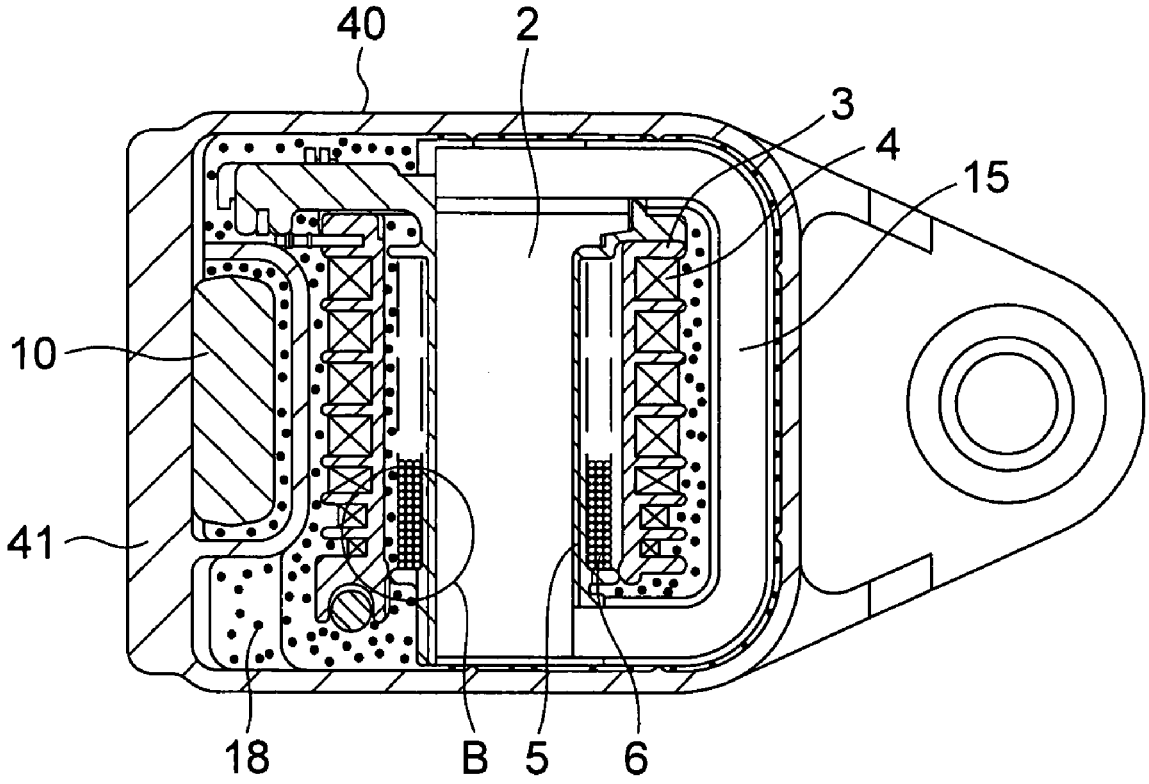
FIG. 9 is a cross sectional arrow view along line IX-IX of FIG. 8.
Figure 10:
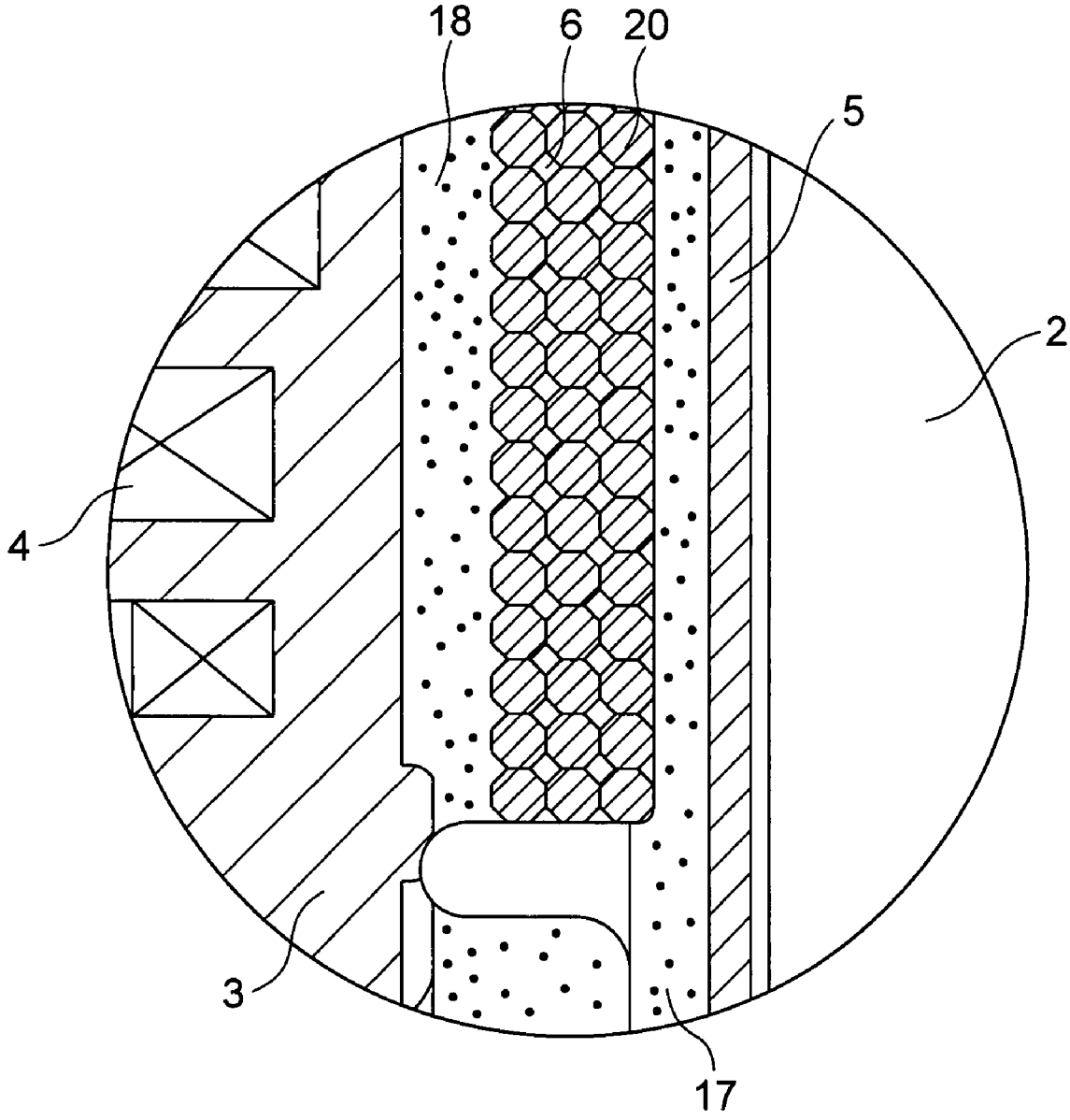
FIG. 10 is an enlarged view of a location B in FIG. 9.

FIG. 8 is a cross sectional front elevational view that shows an ignition apparatus for an internal combustion engine according to a fifth embodiment of the present invention. FIG. 9 is a cross sectional arrow view along line IX-IX of FIG. 8, and FIG. 10 is an enlarged view of a location B in FIG. 9. Although the above-mentioned first through fourth embodiments all relate to ignition apparatuses for an internal combustion engine of a so-called plug hole type, an ignition apparatus for an internal combustion engine of this fifth embodiment relates to an ignition apparatus for an internal combustion engine of a so-called plug top type.

In the ignition apparatus for an internal combustion engine of this fifth embodiment, an insulation casing 40 is composed of a casing main body 41, and a high voltage tower 42 that is integrally formed with the casing main body 41. A connector 43 is formed on a side surface of the casing main body 41.

In the casing main body 41, there are received an iron core 2, a primary bobbin 5 that encloses the iron core 2, a primary coil 6 that is formed of a primary coil conductor 20 wound around the primary bobbin 5, a secondary bobbin 3 that encloses the primary coil 6, and a secondary coil 4 that is formed of a secondary coil conductor wound around the secondary bobbin 3, and an igniter 10.

The high voltage tower 42 is plugged with a high-voltage side secondary coil terminal 16. The high voltage tower 42 has a spring (not shown) received therein, and a plug boot (not shown) made of rubber is fitted over the outside of the high voltage tower 42.

In the primary coil 6, the primary coil conductor 20 has an octagonal shape in cross section, as shown in FIG. 10, and the adjacent portions of the primary coil conductor 20 are in surface to surface contact with each other. Four grooves 17 are formed on the outer peripheral surface of the primary bobbin 5 around which the primary coil conductor 20.

The iron core 2, the primary bobbin 5, the primary coil 6, the secondary bobbin 3, the secondary coil 4 and the igniter 10, which are all received in the insulation casing 41, are insulated and fixedly held by the insulating resin 18 filled in the insulation casing 41.

According to the ignition apparatus for an internal combustion engine of this fifth embodiment as constructed above, the primary coil conductor 20 has an octagonal shape in cross section, so the adjacent portions of the primary coil conductor 20 are in surface to surface contact with each other, and the grooves 17 are formed on the outer peripheral surface of the primary bobbin 5 at four locations. Accordingly, the same advantageous effects as in the first embodiment can be achieved.

Here, note that in the ignition apparatus for an internal combustion engine according to this fifth embodiment, too, the grooves 17 may be formed only in a high voltage region of the primary bobbin 5 that is arranged in opposition to a high voltage portion of the secondary coil 4, similar to the above-mentioned second embodiment, In addition, similar to the above-mentioned third embodiment, a self-bonding film 21 comprising a polyvinyl butyral type resin may be formed on the surface of the primary coil conductor 20 having an octagonal cross section, and the adjacent portions of the primary coil conductor 20 may be bonded to each other to integrate the primary coil 6, thereby removing the primary bobbin 5.

Further, similar to the above-mentioned fourth embodiment, there may be used a primary coil conductor 30 having a square cross section with its corners being chamfered.

While the invention has been described in terms of preferred embodiments, those skilled in the art will recognize that the invention can be practiced with modifications within the spirit and scope of the appended claims.

What is claimed is:

1. An ignition apparatus for an internal combustion engine comprising:

a primary bobbin;

a primary coil that is formed of a primary coil conductor wound around said primary bobbin;

a secondary bobbin that is arranged in concentric relation to said primary bobbin;

a secondary coil that is formed of a secondary coil conductor wound around said secondary bobbin;

an insulation casing that receives said primary bobbin, said primary coil, said secondary bobbin and said secondary coil; and an insulating resin that is filled into said insulation casing;

wherein a groove for guiding said insulating resin between said primary bobbin and said primary coil is formed on an outer peripheral surface of said primary bobbin around which said primary coil conductor having a polygonal cross section is wound.

2. The ignition apparatus for an internal combustion engine as set forth in claim 1, wherein said groove is formed only in a region that is arranged in opposition to a high voltage portion of said secondary coil.

3. The ignition apparatus for an internal combustion engine as set forth in claim 1, wherein the polygonal shape of said primary coil conductor is rectangular.

4. The ignition apparatus for an internal combustion engine as set forth in claim 1, wherein said primary coil conductor has corners of said cross section chamfered.

5. The ignition apparatus for an internal combustion engine as set forth in claim 1, wherein said polygonal cross section of said primary coil conductor is an octagon.

6. The ignition apparatus for an internal combustion engine as set forth in claim 1, wherein said primary bobbin extends in an axial direction and said groove is formed along said axial direction.

7. The ignition apparatus for an internal combustion engine as set forth in claim 2, wherein:

said primary coil conductor is wound around said primary bobbin in a number of layers in a radial direction, the number of layers of said primary coil conductor in a region that is arranged in opposition to a low voltage portion of said secondary coil is greater than the number of layers of said primary coil conductor in the region that is arranged in opposition to the high voltage portion of said secondary coil.

* * * * *